US012433455B2

(12) United States Patent
Brascom

(10) Patent No.: US 12,433,455 B2
(45) Date of Patent: Oct. 7, 2025

(54) SHOE SOLE CLEANING APPARATUS

(71) Applicant: Kia Brascom, Tampa, FL (US)

(72) Inventor: Kia Brascom, Tampa, FL (US)

( * ) Notice: Subject to any disclaimer, the term of this patent is extended or adjusted under 35 U.S.C. 154(b) by 197 days.

(21) Appl. No.: 18/122,090

(22) Filed: Mar. 15, 2023

(65) Prior Publication Data

US 2024/0306861 A1 Sep. 19, 2024

(51) Int. Cl.

| | |
|---|---|
| ***A47L 23/10*** | (2006.01) |
| ***A47K 10/38*** | (2006.01) |
| ***B65D 83/08*** | (2006.01) |
| *A47K 10/32* | (2006.01) |

(52) U.S. Cl.

CPC ..... *A47K 10/3827* (2013.01); *A47L 23/10* (2013.01); *B65D 83/0805* (2013.01); *B65D 83/0894* (2013.01); *A47K 2010/3233* (2013.01); *A47K 2010/3266* (2013.01)

(58) Field of Classification Search

CPC ..... B65D 83/0894; B65D 83/0805; A47K 10/3827

USPC ..... 221/33–63

See application file for complete search history.

(56) References Cited

U.S. PATENT DOCUMENTS

| | | | | |
|---|---|---|---|---|
| 2012/0160864 | A1* | 6/2012 | Shoaf | A47K 10/421 221/45 |
| 2014/0175110 | A1* | 6/2014 | Bechyne | A47K 10/421 221/45 |
| 2014/0217111 | A1* | 8/2014 | Sampson | G07D 11/16 221/277 |

* cited by examiner

*Primary Examiner* — Gene O Crawford
*Assistant Examiner* — Ayodeji T Ojofeitimi
(74) *Attorney, Agent, or Firm* — Michael C Casarano

(57) ABSTRACT

A shoe sole cleaning apparatus comprises a housing containing a continuous sheet of towelettes that extends through an opening in the housing and may be positioned atop a supporting front panel. Individual towelettes may be infused with a cleaning solvent. When a shoe sole is pressed upon the towelette, the front panel provides support to hold the towelette against the sole and the shoe sole may be cleaned of debris and bacteria or germs that may have become attached to the sole. The towelette may be torn off the sheet and discarded after use.

2 Claims, 9 Drawing Sheets

SHOE SOLE CLEANING APPARATUS

BACKGROUND

A common problem when traveling is that foreign substances may come into contact with an individual's shoes in public places, such as when entering a public restroom where the soles of the shoes may come into contact with disease causing germs and bacteria from the floor. Such germs and bacteria may then be carried on the shoes into a car or other vehicle, and ultimately into one's home, hotel, or office. Humans coming into contact with such germs and bacteria are at risk of developing illness and disease.

This chain of events may be mitigated or alleviated if the germs and bacteria can be removed or sanitized from the soles of the shoes upon the individual's entering a vehicle for further travel to a destination. At present, however, systems for easily cleansing the soles of one's shoes upon entering an automobile or other vehicle are nonexistent. At best, what is available requires the individual to use his or her hands to rub a rag or tissue against the shoe sole to remove any dirt, germs and bacteria. What is needed is a moist towelette-dispensing apparatus that permits one to clean the soles of his or her shoes without requiring the user to manually remove the germs and bacteria by rubbing the towelette across the soles using their hands.

SUMMARY AND OBJECTS OF THE INVENTION

The shoe sole cleaning apparatus of this invention is a towelette-dispensing container having a substantially sealable container forming a housing comprising a three-dimensional open box, an openable lid to enclose the volume in a substantially hermetically sealed space, and a rigid or semi-rigid front panel extending forward of the dispenser and situated to hold the towelette flat against the panel where the shoe sole may be rubbed against it. A horizontal slit in the housing, or a slightly trimmed edge of a wall of the housing forms a thin opening through which a continuous sheet of perforated towelettes may be threaded.

A roll of absorbent or solvent-infused sheets that has perforations to permit tearing-off of individual towelettes following use is situated within the housing. The outermost layer of the roll forms a sheet that extends through the thin opening. The sheet may be pulled to extract towelettes from the container in a continuous sheet where the endmost towelette may be situated on the extended panel. After being used, the endmost towelette may then be torn off of the roll and discarded. Flexible plastic or similar substance "lips" may be mounted on either side of the slot, and will prevent dry, ambient air from freely entering the housing, thereby maintaining a moisturized environment within the container and keeping the roll moist while still permitting towelettes to be extracted through the opening. In an embodiment, towelettes may be moist or damp. In an alternative embodiment, the towelettes may be dry.

When not in use, the front panel may be folded upwardly and around the housing so as to retain moisture within the housing and to reduce the size of the apparatus. The front panel may be articulated so as to fold at two or more smaller flat panels or may be flexible to permit upward folding in a curved shape around the housing.

The dispenser is completely portable and is sized to fit on the carpeting immediately beneath the front of the front passenger seat of an automobile or other vehicle. When not in use, the front panel of the dispenser may be folded up and around the housing, and the dispenser will be substantially out of the way of a passenger's feet, being tucked against the lower front edge of the passenger's seat. The apparatus extends substantially across the width of the seat and may have a roughened lower surface to hold the dispenser from slipping when in use or while the vehicle is in motion.

In a preferred embodiment, the thin opening for the roll of towelettes is at or near the top of the front of the housing and an openable lid will be hinged at the rearward area of the housing. In another embodiment, the towelette opening may be at the lower part of the housing slightly above the front panel, and the housing may be hinged to the front plate at the rear of the housing. In either embodiment, the end of the towelette roll may be pulled through the thin opening and spread flat onto the front panel where a dirty shoe sole may be wiped against it. After the towelette has been used, it can be torn off the sheet at a perforated edge and discarded. The next towelette on the roll may then be pulled through the thin opening and positioned for use.

In a further embodiment, a lid may be hinged at the midpoint of the housing, and may be held tightly closed with a spring or other comparable mechanism. The housing may be comprised of plastic or a similar non-liquid absorbent material and is large enough to contain a roll of absorbent or solvent-infused towelettes. In a preferred embodiment, moist towelettes may be used, although dry towelettes may be preferable for non-standard situations or applications. Towelettes extend continuously on the roll, and individual towelettes may separated by a perforated line that extends across the roll, providing a narrow zone where each towelette may be torn off of the roll after use. A new towelette may then be pulled through the narrow opening and positioned on the front plate for use.

In an embodiment the bottom surface of the housing may be removably attached to the floorboard of the vehicle immediately adjacent to the lower front of the passenger seat. For vehicles having carpeted floorboards, Velcro or a similar hook-and-loop fastener may be sufficient to hold the container in place. In other situations, one or more expandable cords, such as a bungee cord, may be suitable to hold the container at the base of the passenger seat, or a light adhesive or double-sided tape may be used.

For stability and enhanced placement and resistance to movement, the base of the dispenser may be extended forward, beyond the front vertical wall of the housing, thereby providing increased contact area between the dispenser and the floorboard and preventing the dispenser from tipping when a towelette is being extracted or separated from the roll. In an embodiment, the extended base may be semi-flexible, having been molded as a flat surface, but flexible enough to be curled upward and around the housing and having a fastening mechanism to hold the curved front plate to the housing. As so fastened, the front plate serves as a barrier against the escape or evaporation of moisture from the dispenser, thereby keeping the towelettes moist prior to usage. In an embodiment, the fastening mechanism may be an elastic band suitable for wrapping tightly around the apparatus and holding the flexible front panel against the housing.

It is an object of the invention to provide a wet or dry towelette dispenser that is situated on the floorboard at the base of a passenger seat in an automobile. It is a further object of this invention to provide a dispenser that is removably attached to the floorboard or passenger seat of an automobile that will remain stationary when towelettes are being pulled singly through a slotted opening for use. It is another object of the invention to provide a dispenser that will receive a roll of towelettes and that may be refilled when each roll has been exhausted. It is yet a further object of the invention to provide a dispenser having a flat base extending past the dispenser housing that may be curled around the housing when the dispenser is not being used.

These and further objects of the invention are explained in greater detail in the description of the preferred embodiments.

DETAILED DESCRIPTION OF THE PREFERRED EMBODIMENTS

Figure 1:
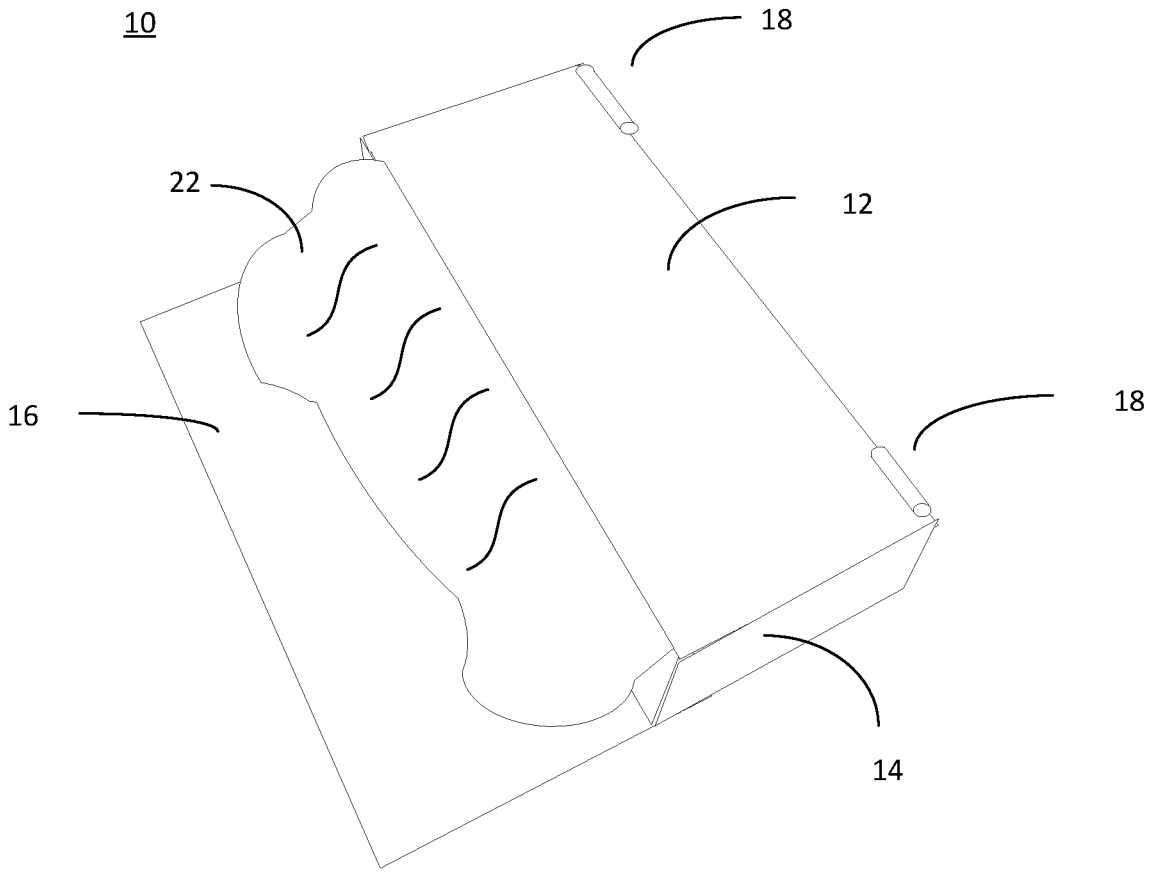
FIG. 1 is a perspective view of the dispenser with a towelette extending through the dispensing slot.

FIG. 1 is a perspective view of the dispenser 10 of the invention. A housing 14 has a lid 12 attached by two hinges 18. The lid opens when necessary to refill the dispenser. A plain, moist, or solvent-infused paper towelette 22 is extending through the dispensing slot. The dispenser is sealed to create a moisturized environment that will maintain damp towelettes in a moistened condition for periods of time that may extend for weeks or months. An extended base, 16 provides a stable platform to support a towelette when the apparatus is in use.

Figure 2:
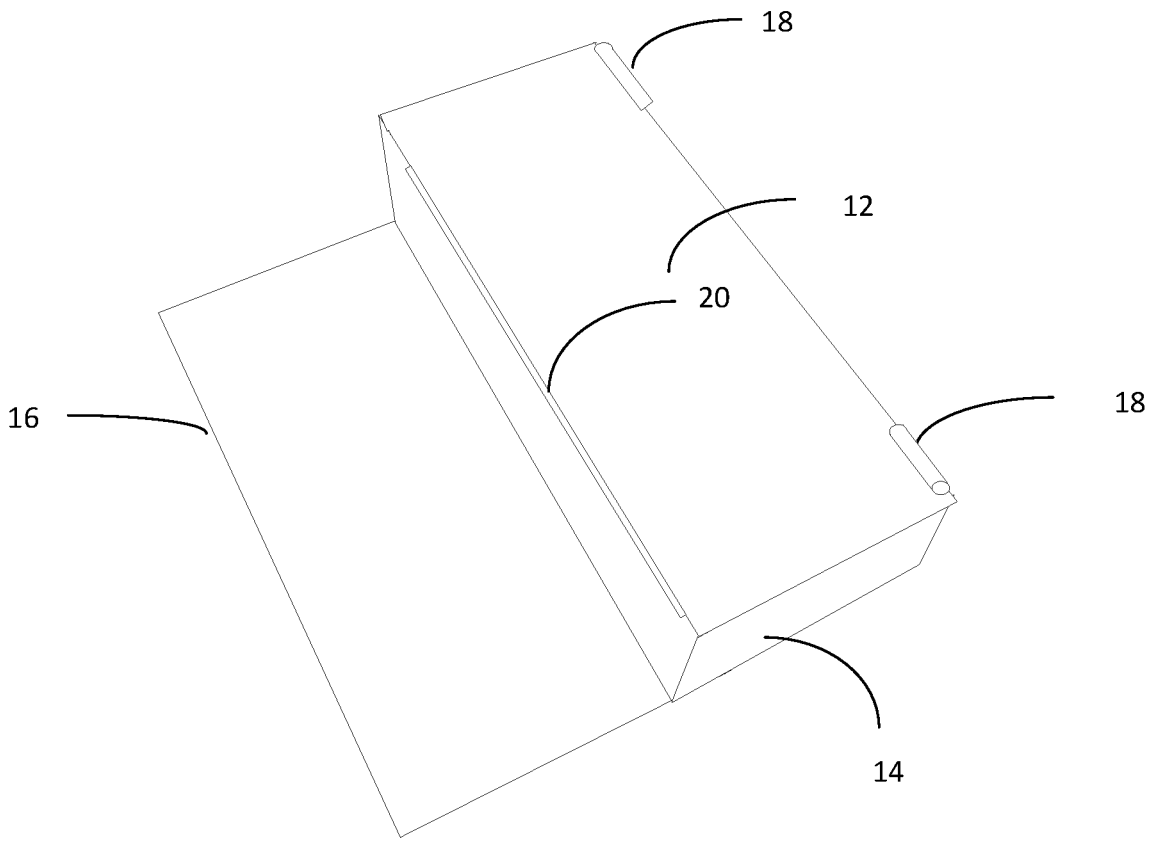
FIG. 2 is a perspective view of the dispenser similar to FIG. 1 but without a towelette extending through the slot and showing the front and top faces of the dispenser.
Figure 3:
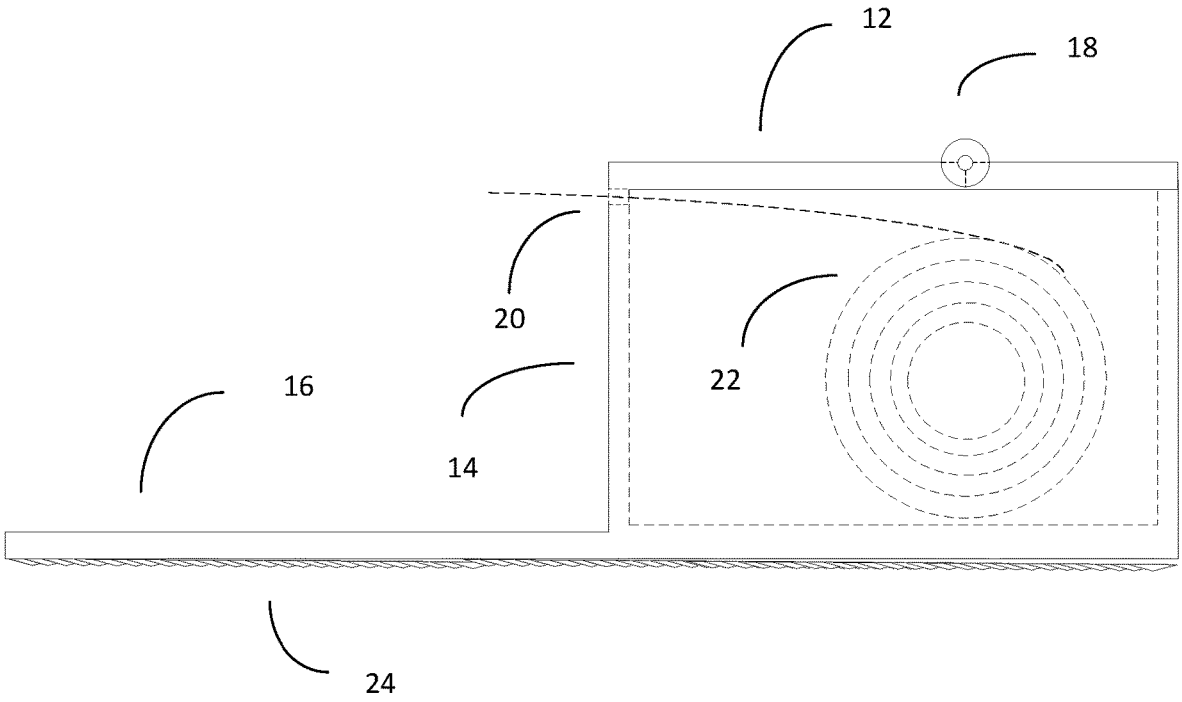
FIG. 3 is a right elevational view showing inner detail of an embodiment of the invention in which the lid hinge is located forward of the rear of the dispenser housing.

In FIG. 2, a dispensing slot 20 is visible. In operation, lid 12 will be opened to expose the interior of the housing which will hold a roll of wet or dry towelettes. As shown in FIG. 3, a roll of towelettes 22 is maintained within the housing, and one end of the roll is threaded through slot 20 where it may be grasped and extracted. A continuous roll having perforations for each towelette is used, and when one towelette is extracted, an adjacent towelette is pulled to and through the slot and is immediately ready for use.

A slip-resistant mechanism 24 is applied to the bottom of the dispenser. It may comprise a hook and loop system, such as Velcro, where the automobile floorboard in front of the passenger seat is covered with a carpet. In other embodiments, the slip resistant surface may be a rough surface that will resist slippage, or may consist of a light adhesive, such as double-sided tape, to hold the dispensing unit in place. In some embodiments, elastic cords such as bungee cords may hold the dispensing unit securely against the lower front part of the passenger seat. As shown in FIG. 3, a hinge 18 is located at the top of the housing, slightly forward of the vertical rear housing wall, and an openable lid 12 extends partially over the top of the housing. This configuration may be suitable for automobiles in which the passenger seat extends forward over the dispenser such that a full-sized lid may be difficult to open.

Figure 4:
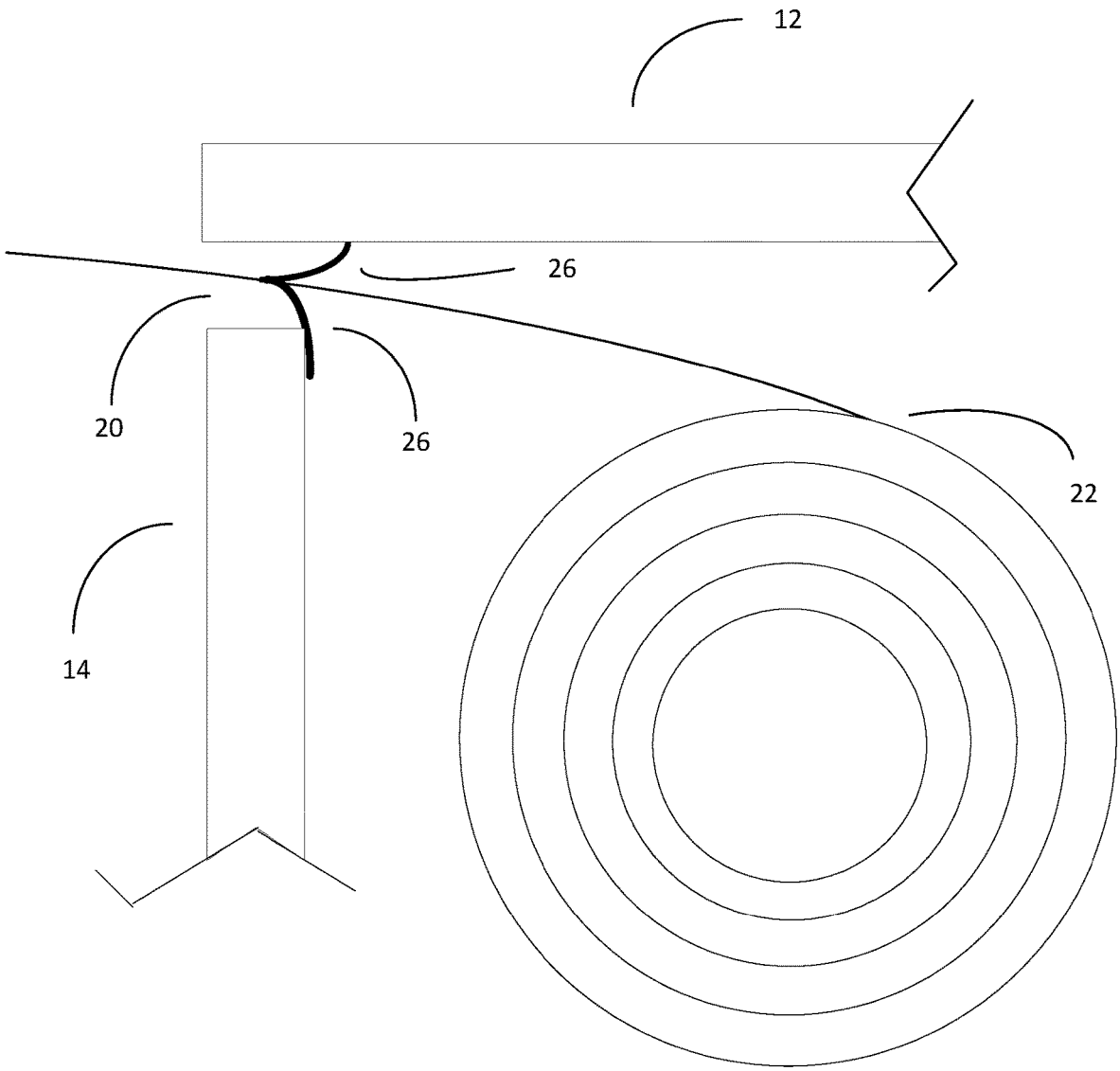
FIG. 4 is a partial right elevational view showing detail of a towelette extending through the slot including flexible "lips" that retain moisture in the dispenser.

FIG. 4 depicts a moisture-conserving mechanism situated immediately behind the dispensing slot. Flexible "lips" 26 are in contact with both sides of the towelette being dispensed, thereby preventing the free flow of air into the dispensing unit. In this manner, a moisturized environment can be maintained within the housing and moisture infused towelettes will retain the moisture for an indefinite length of time.

Figure 5:
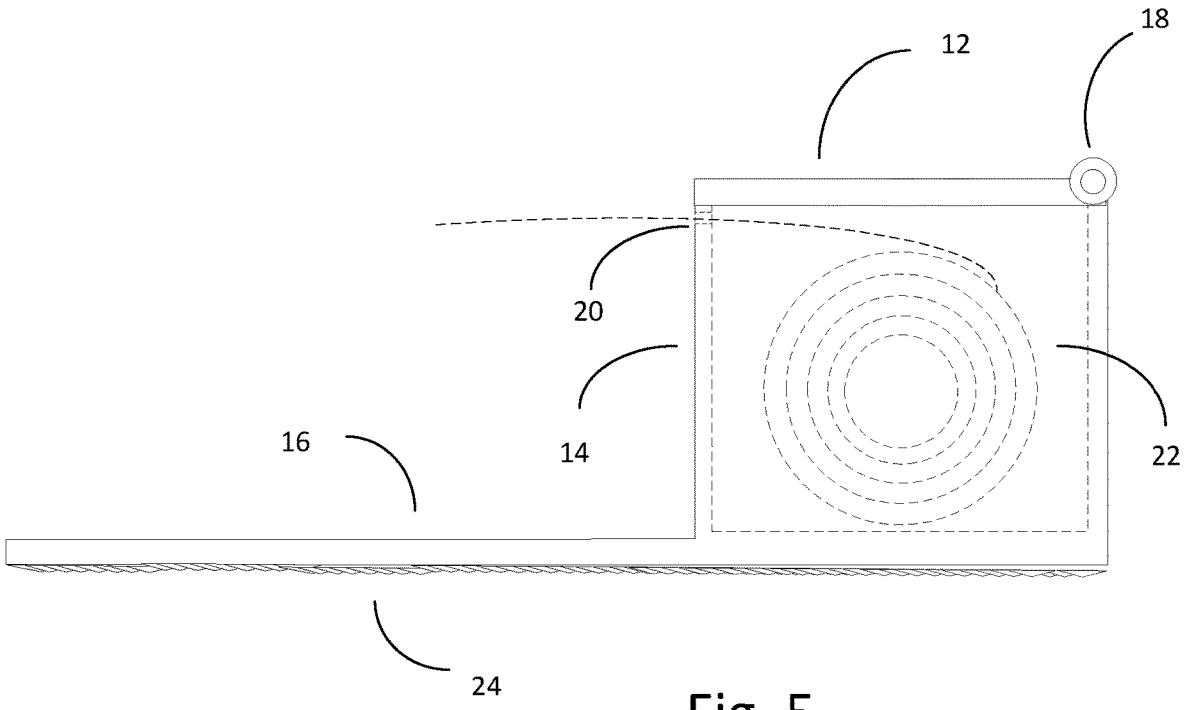
FIG. 5 is a right elevational view of an embodiment in which the hinge is located at the rear of the dispenser housing.

FIG. 5 depicts a dispensing container in which a hinge 18 is situated at the rear of the housing and the lid 12 will open to uncover substantially all of the housing interior. In an embodiment, the housing may be sized to hold a roll with a minimal clearance whereby the unit will take up less space at the passenger's feet within the automobile.

Figure 6:
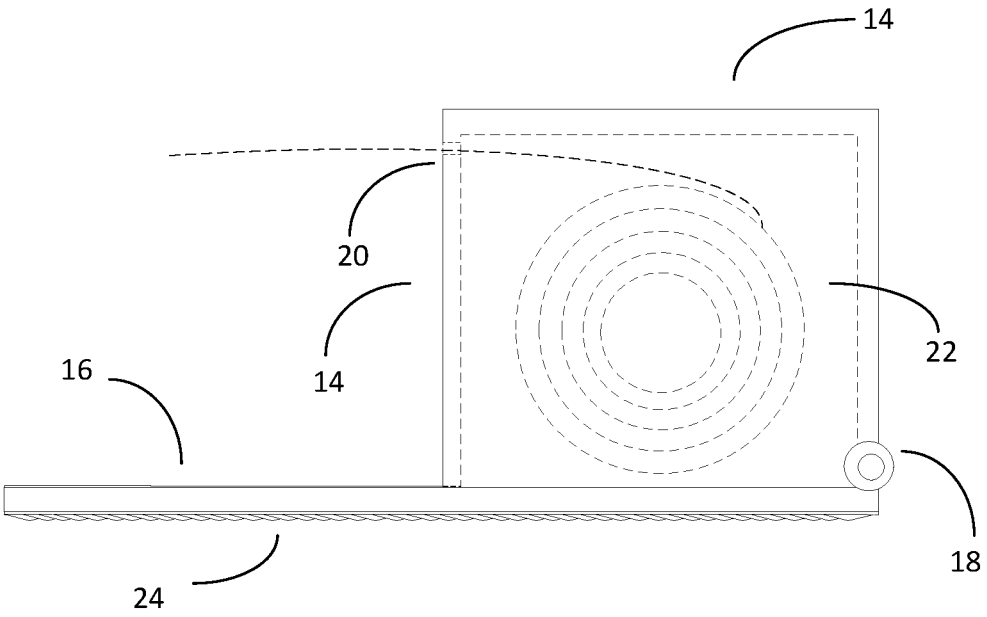
FIG. 6 is a right elevational view depicting an embodiment in which there is no lid, and the hinge is located at the rear base of the dispenser housing.
Figure 7:
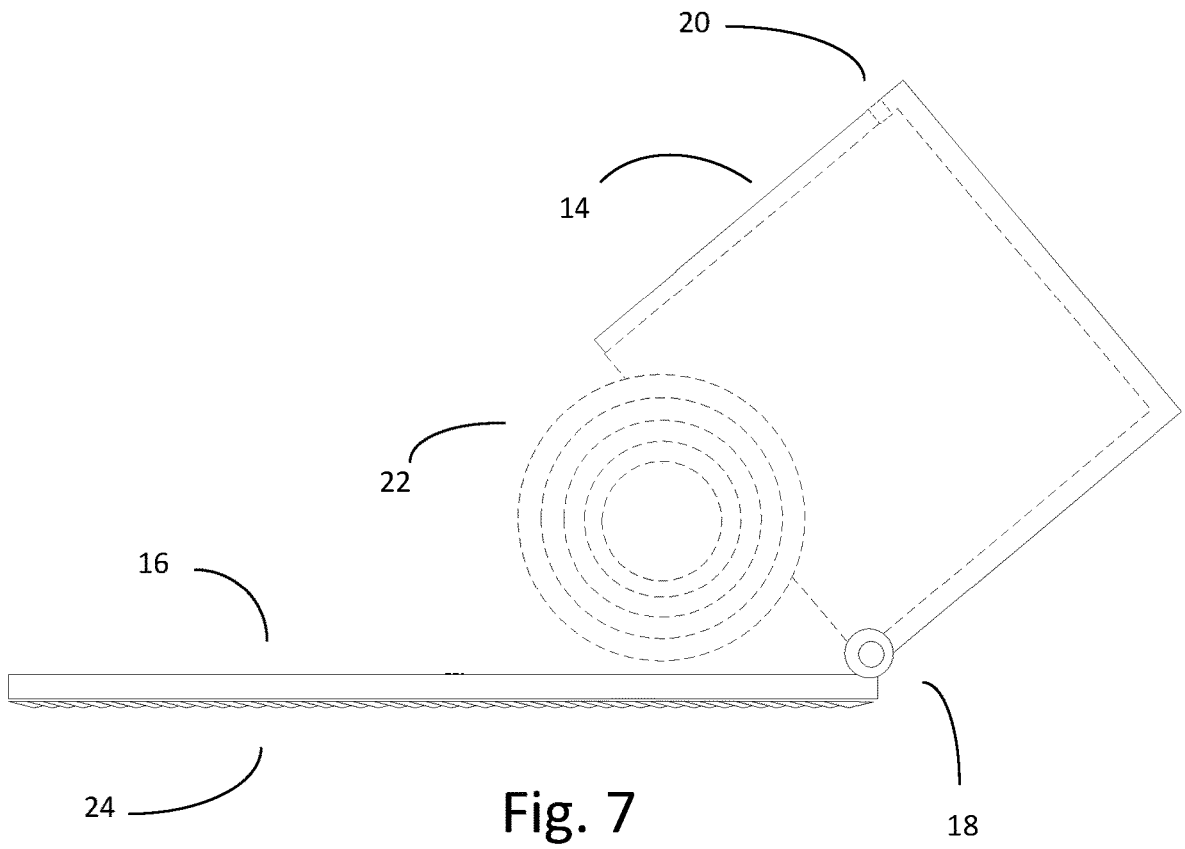
FIG. 7 depicts the dispenser of FIG. 6 with the housing open for receiving a fresh roll of dispensing towelettes.

FIGS. 6 and 7 depict an embodiment in which there is no separate lid, and the entire housing is lifted to allow the insertion of a new roll. A hinge 18 is located at the base of the housing at the rear of the dispenser, and the entire housing is raised to create the necessary opening. In this embodiment, a dispensing slot is situated near the top of the housing so that a passenger can grasp a towelette without having to reach farther than the top of the dispenser.

Figure 8:
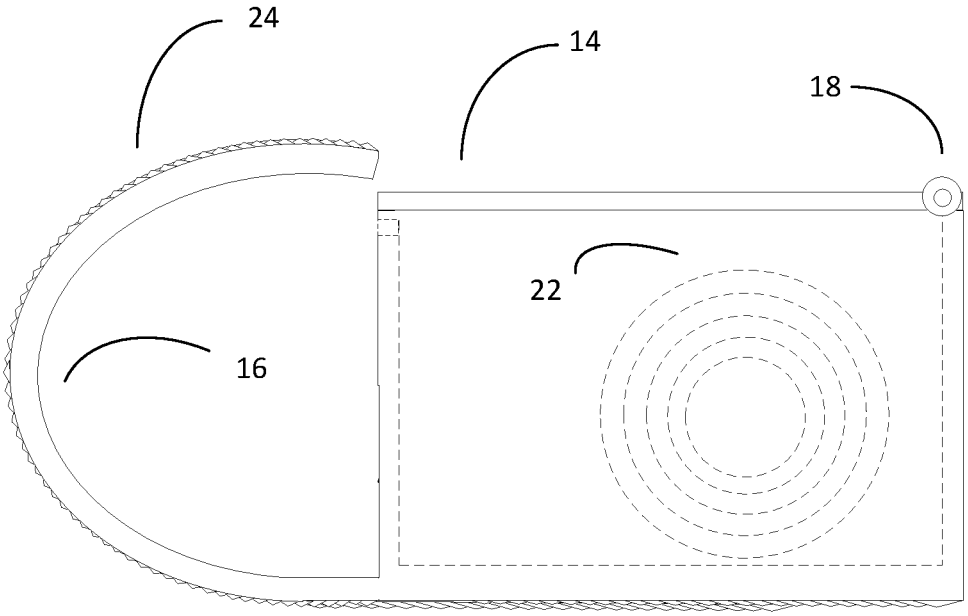
FIG. 8 is a right elevational view depicting an embodiment in which the front extension of the base has been curled around the housing to facilitate transport and minimize the size of the unit when not being used.

FIG. 8 depicts an embodiment in which the extended base 16 may be folded or curled up, around the housing, thereby freeing up floor space at a passenger's feet. This may be beneficial when a passenger enters or exits the vehicle and will minimize the space needed for the dispenser when it is being stored outside of the vehicle or when there is no need to have it available.

Figure 9:
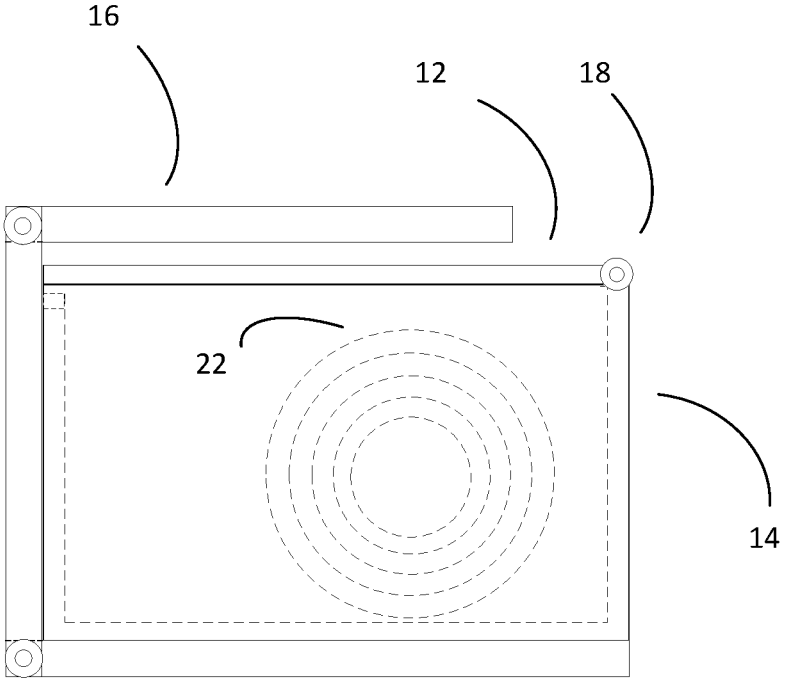
FIG. 9 is a right elevational view depicting an embodiment in which the front extension of the base comprises articulated segments and which is wrapped up and around the housing.

FIG. 9 depicts an embodiment in which the front panel 16 consists of articulated sections which may be rigid, and which have been sized to fold upwardly and rearwardly about the housing. A folded articulated section rests against the dispensing slot 20 and may assist in retaining moisture within the housing by sealing the slot and preventing dry, ambient air from freely entering the housing.

Although the present invention has been particularly shown and described with reference to the preferred embodiments, it will be understood by those skilled in the art that various changes in form and detail may be made without departing from the spirit and scope of the invention.

I claim:

1. A towelette dispensing device comprising a housing, a lid, and a front panel, said housing and said lid enclosing an interior space configured to receive a sheet of towelettes, said lid being openable to permit the insertion of a sheet of towelettes into said interior space, said front panel extending outwardly from said housing and forming a surface for receiving one or more towelettes, an elongated opening adjacent said front panel and configured to allow the passage of one or more towelettes from said interior space to said front panel, wherein said front panel extends from the lower portion of said housing and may be folded upwardly to reduce the dimensions of said dispensing device.

2. The towelette dispensing device of claim 1, said front panel being upwardly foldable around said dispensing device.

* * * * *